United States Patent [19]

Ballinger et al.

[11] Patent Number: 4,934,633

[45] Date of Patent: Jun. 19, 1990

[54] CROSSING CONTROL UNIT

[75] Inventors: Forrest H. Ballinger, Grain Valley; Wilfred L. Farnham; William G. Schneider, both of Blue Springs, all of Mo.

[73] Assignee: Harmon Industries, Inc., Blue Springs, Mo.

[21] Appl. No.: 255,135

[22] Filed: Oct. 7, 1988

[51] Int. Cl.[5] ..... B61L 5/18; H05B 41/14

[52] U.S. Cl. ..... 246/473.1; 246/125; 315/132; 315/209 A

[58] Field of Search ..... 246/125, 130, 111, 114 R, 246/218, 293, 473 R, 473.1; 315/132, 133, 200 A; 116/63 R

[56] References Cited

U.S. PATENT DOCUMENTS

| | | | |
|---|---|---|---|
| 1,450,548 | 4/1923 | Howard | 315/132 X |
| 1,902,799 | 3/1933 | Day | 246/125 |
| 2,137,196 | 11/1938 | Sampson | 246/473.1 |
| 3,740,550 | 6/1973 | Geiger | 246/125 |
| 3,875,525 | 4/1975 | Ballinger et al. | 246/130 X |
| 4,118,750 | 10/1978 | Auer, Jr. et al. | 246/473.1 X |
| 4,581,700 | 4/1986 | Farnham et al. | 246/125 |
| 4,703,303 | 10/1987 | Snee | 246/125 X |

*Primary Examiner*—Andres Kashnikow
*Assistant Examiner*—Timothy Newholm
*Attorney, Agent, or Firm*—D. A. N. Chase

[57] ABSTRACT

Warning lights at a railroad grade crossing are energized at a predetermined flash rate when a train is approaching through the use of an essentially fail-safe solid state crossing controller employing circuitry that is active in creating an off condition of the warning lamps. A controller unit operates a pair of warning lamps alternately in synchronism with a warning rate (flash rate) signal having a predetermined repetition rate, such as 55 pulses per minute. When the crossing is safe, an RC circuit in the lamp driver responds to a 500 Hz safe status signal by providing continuous control excitation to a normally conductive lamp switching circuit to maintain the lamps deenergized. In a failure mode, the normal condition of the switching circuit maintains one lamp of each pair continuously energized. Alternate flashing of a lamp pair is accomplished in synchronism with the warning rate signal by alternating an oscillator at the flash rate between two output frequencies and applying the oscillator output as modulation on the supply current to the lamps. Additional lamp pairs are operated by independent control units all responsive to the alternating oscillator output.

10 Claims, 2 Drawing Sheets

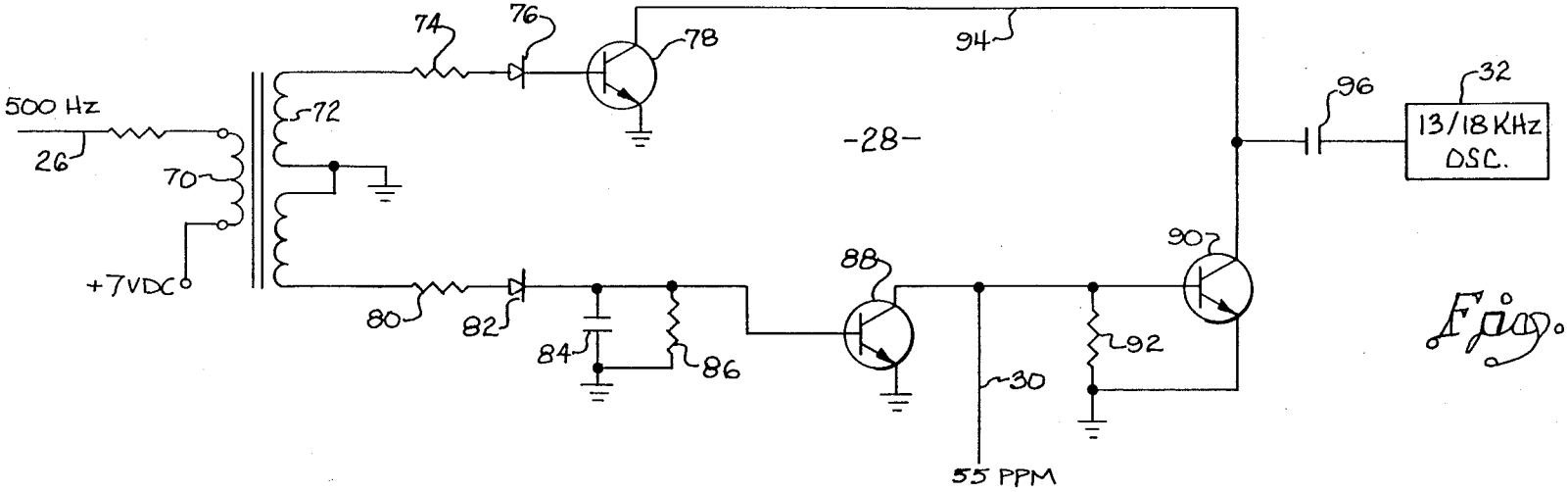
Fig. B.
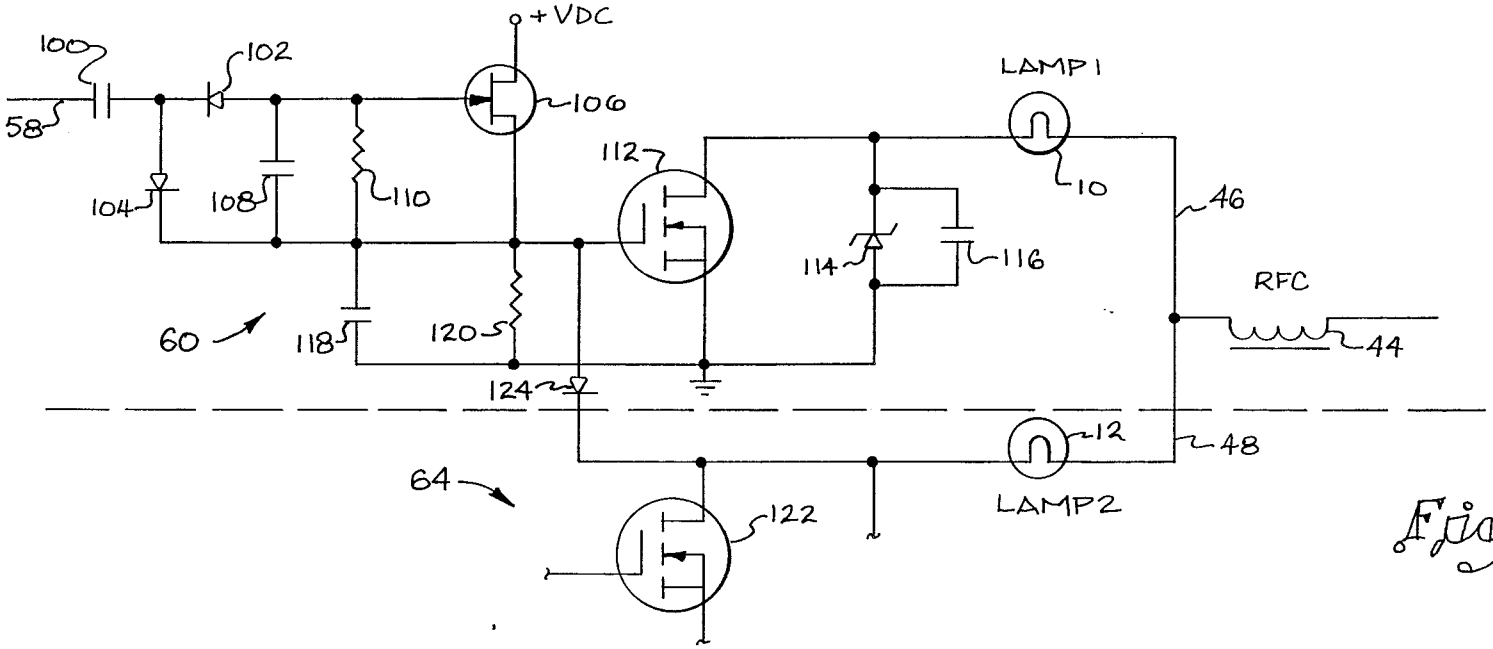
Fig. A.

CROSSING CONTROL UNIT

This invention relates to improvements in methods and apparatus for operating warning devices at grade crossings when a railroad train is approaching or is present at the crossing and, in particular, to an essentially fail-safe system which is active in creating an off condition of the warning devices.

Protected grade crossings are, at a minimum, provided with visually recognizable or audible warning devices that are operated electrically and are energized in response to an approaching train. Flashing lights are commonly employed in pairs that are alternately energized at a flash rate of approximately 55 pulses per minute, i.e., 55 flashes each minute alternately from the two lamps. Prior art controllers traditionally utilize mechanical flashing relays which, though reliable, are expensive and require maintenance. More recent solid state techniques reduce expense and maintenance requirements but present reliability problems due to the greater possibility of component failure.

It is, therefore, the primary object of the present invention to provide an improved solid state crossing controller having circuitry which is active in creating an off condition of the warning devices rather than active in energizing the devices in response to an approaching train.

As a corollary to the foregoing object, it is an important aim of this invention to provide circuitry having a normal condition in which the warning devices are energized and an excited or active condition in which the devices are deenergized, in order that a control system may be provided which is essentially fail-safe.

Another important object of the present invention is to provide a crossing controller as aforesaid which responds to either of two signals of different frequencies depending upon the status of the crossing, a warning rate signal for initiating operation of the devices at the warning rate when a train is approaching, and a safe status signal for causing the circuitry to assume an active condition in the absence of a train.

Furthermore, it is another important object of the invention to provide a means of operating a pair of warning devices, such as electric lamps, in an alternating mode utilizing a single power lead between the trackside power supply and the warning units, through the use of a modulation technique that superimposes the warning rate and safe status signals on the energizing current for the lamps.

Still another important object is to provide a driver for a lamp or other warning device which is frequency sensitive and capable of distinguishing between warning rate and safe status signals, and which maintains a solid state switching circuit in an excited condition in response to the safe status signal to, in turn, maintain the lamp deenergized in a fail-safe manner.

Yet another important object is to provide a method and apparatus for operating two warning devices, such as electric lamps, alternately at a predetermined flash rate through the use of an oscillator that produces a control signal having two frequency components to which the two lamps are respectively responsive, the output of the oscillator being alternated between the two frequencies in synchronism with a warning (flash) rate signal when a train is approaching or present at the crossing.

Further objects will become apparent as the detailed description proceeds.

DESCRIPTION OF THE DRAWINGS

FIG. 3 is an electrical schematic diagram showing the high/low frequency gate in detail.

FIG. 4 is an electrical schematic diagram showing one of the lamp driver circuits in detail.

SYSTEM SUMMARY

Figure 2:
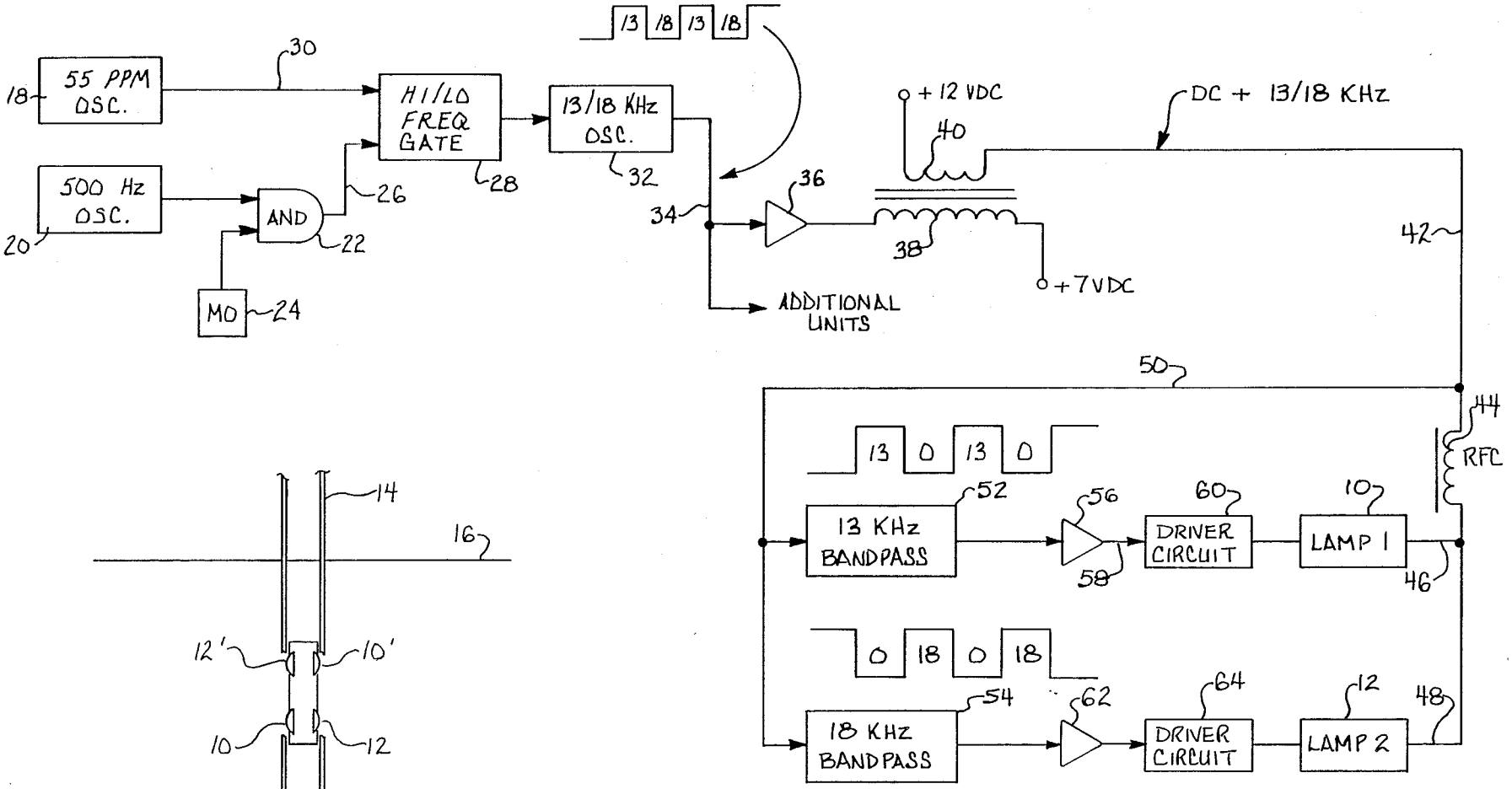
FIG. 2 is a block diagram of the crossing control unit of the present invention.

The functional elements of the preferred embodiment of the present invention are shown in the block diagram of FIG. 2, which illustrates a crossing controller for operating two warning lamps 10 and 12. The objective of the system is to alternately flash lamps 10 and 12 at a flash rate of 55 pulses per minute, which means that the lamps would be alternately energized 55 times over a period of one minute. This produces the familiar alternate flashing of a lamp pair facing oncoming traffic at a grade crossing.

Figure 1:
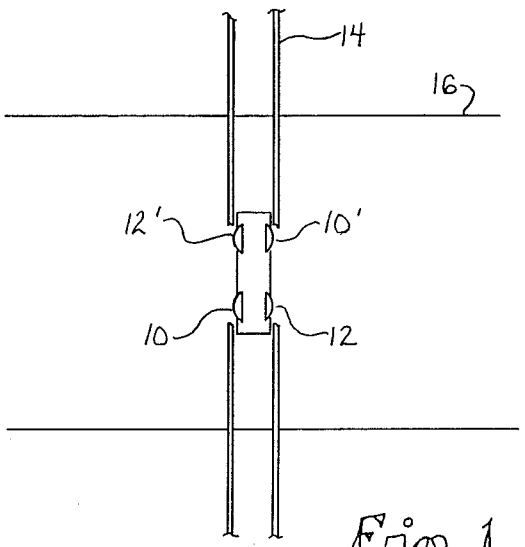
FIG. 1 is a diagrammatic, plan view of an exemplary grade crossing showing a pair of warning lights facing vehicular traffic from each direction.

However, as illustrated in FIG. 1, it is preferable in the present invention that the two lamps 10 and 12 under the control of the unit of FIG. 2 face in opposite directions. As will be explained, a second crossing control unit would preferably operate a second pair of lamps 10' and 12' for additional safety in the event of a failure as will be subsequently explained. FIG. 1 shows railroad tracks 14 intersected by a roadway 16 which presents a crossing protected by the four lamps illustrated. Lamps 10 and 12' face traffic approaching from the left, and lamps 10' and 12 face traffic approaching from the right.

A square wave oscillator 18 (FIG. 2) operating at a frequency slightly under one Hz produces a warning rate signal having a repetition rate of 55 pulses per minute. A second square wave oscillator 20 produces a safe status signal having a frequency of 500 Hz which is fed to one input of a two-input AND gate 22. The other input of the AND gate 22 is enabled by the output of a motion detector 24 when a train is not approaching the crossing. It should be understood that the motion detector 24 may comprise a conventional system for detecting the approach of a train such as illustrated in U.S. Pat. No. 4,581,700, issued April 8, 1986, owned by the assignee herein. Furthermore, it should be understood that an island circuit (not shown) may also be provided which would sense the presence of a stationary train at the crossing and enable the same input of AND gate 22 when a train is not present. Accordingly, the 500 Hz safe status signal is delivered along a line 26 to a high/-low frequency gate 28 under conditions in which a train is neither approaching the protected crossing nor present thereat.

The 55 PPM warning rate signal is present on a lead 30 extending from the output of oscillator 18 to a second input of the gate 28. As will be discussed in detail hereinafter with respect to FIG. 3, the gate 28 responds to the 500 Hz safe status signal whenever it is present on line 26. When it is not present, the gate 28 responds to the 55 PPM warning rate signal.

An astable multivibrator 32 provides an oscillator whose output is under the control of the gate 28 and is alternated between 13 KHz and 18 KHz. In response to the 55 PPM warning rate signal, the gate 28 toggles the output of oscillator 32 at the 55 PPM rate; likewise, in response to the 500 Hz status signal the output of oscillator 32 alternates at 500 Hz. The purpose of this action is to provide a two-component control signal at the output of the oscillator 32 for alternately flashing lamps 10 and 12 when a train is approaching. The control signal appears on line 34 extending from the output of oscillator 32, and the wave form illustration depicts the envelope of the alternating half cycles of the control signal and shows that the 13 KHz frequency component is generated for one half cycle, followed by the 18 KHz frequency component, etc.

After amplification at 36, the control signal is applied to the primary 38 of a modulation transformer. The seven-volt DC supply to the primary 38 is regulated voltage for the operation of solid state components comprising amplifier 36. The secondary 40 of the transformer is at the operating voltage of lamps 10 and 12 (illustrated as 12 volts direct current) and thus the modulation transformer superimposes the 13/18 KHz control signal on the energizing current which is fed to the lamps via a single conductor 42. Preferably, the circuitry just discussed would be physically located in association with the trackside power unit, with the driver circuitry to be discussed below located at the warning unit containing the lamps 10 and 12. Accordingly, by modulating the energizing current with the control signal, only the single conductor 42 and an electrical return are required between the lamp supply circuit board and the driver circuit board associated with the lamps 10 and 12.

At the warning unit the control signal is suppressed by an in-line RF choke 44 and positive power connections are made to both lamps via leads 46 and 48 respectively. A lead 50 extends from a connection with conductor 42 ahead of the choke 44 and feeds the composite signal to a 13 KHz bandpass filter 52 and an 18 KHz bandpass filter 54. The output of filter 52, containing only the 13 KHz modulation, is fed to an amplifier 56 and then via a lead 58 to a driver circuit 60 which switches the ground side of lamp 10. In like fashion, only the 18 KHz component of the control signal is present at the output of bandpass filter 54 and is then amplified at 62 and delivered to a driver circuit 64 that switches the ground side of lamp 12. The wave form diagrams in FIG. 2 associated with filters 52 and 54 respectively illustrate that alternate half cycles of the envelope of the output from each filter contain either the passed control signal component or no signal, and further illustrate that when the control signal component is present at the output of one filter 52 or 54, the other filter is at zero output. In the subsequent discussion of FIG. 4, it will be seen that this results in alternate flashing of the two lamps at the 55 PPM rate when a train is approaching or present at the crossing.

HIGH/LOW FREQUENCY GATE

The circuit details of the high/low frequency gate 28 are shown in FIG. 3. The 500 Hz safe status signal, when delivered by the output of AND gate 22, is connected by lead 26 to the primary winding 70 of a transformer having a center tapped secondary winding 72. The maximum and minimum voltage levels of the 500 Hz square wave would, for example, be approximately +12 and −4 volts respectively so the primary winding 70 is energized with an oscillating unipolar signal since its lower end is maintained at +7 volts. The secondary winding 72, being center tapped, is at positive polarity at both ends but 180 degrees out of phase. A series resistor 74 and protective diode 76 connect the top of winding 72 to the base of an NPN transistor 78. The bottom end of winding 72 is connected by a resistor 80 to a rectifier/filter formed by a series diode 82 and a parallel capacitor 84 and resistor 86 to ground. The rectifier/filter is across the base and emitter of an NPN transistor 88.

Lead 30 from the 55 PPM oscillator 18 is connected to the collector of transistor 88, the base of an NPN transistor 90, and a resistor 92 to ground. The emitters of all three transistors 78, 88 and 90 are grounded. The collectors of transistors 78 and 90 are interconnected by a lead 94 from which a capacitor 96 is connected to the 13/18 KHz oscillator 32. When the left plate of capacitor 96 is grounded via the emitter-collector circuit of either transistor 78 or 90, the time constant of the multivibrator (oscillator 32) is increased by the addition of capacitor 96 to thereby reduce its frequency of oscillation from 18 to 13 KHz.

When the 500 Hz safe status signal is present, transistor 78 is switched on and off at the 500 Hz rate to ground capacitor 96 during every other half cycle. Also, transistor 88 is biased into continuous conduction by the presence of 500 Hz due to the charge on capacitor 84. With transistor 88 in conduction, the lead 30 bearing the 55 PPM signal is shorted to ground; accordingly, transistor 90 is off and the capacitor 96 is under the control of transistor 78. Therefore, the output of oscillator 32 will continue to alternate at the 500 Hz rate so long as the crossing is safe.

When the 500 Hz signal is removed from lead 26 by detection of a train, transistors 78 and 88 are released and control of capacitor 96 is shifted to transistor 90. Since transistor 88 is now non-conductive, the 55 PPM warning signal appears across resistor 92 and biases transistor 90 on and off at the 55 PPM rate. Therefore, when the crossing is unsafe the output of the oscillator 32 is alternated at the much slower 55 PPM flash rate.

THE DRIVER CIRCUIT

Driver circuit 60 for lamp 10 is shown in detail in FIG. 4. As driver circuit 64 for lamp 12 is identical, it is shown fragmentarily.

A capacitor 100 at the input of driver circuit 60 blocks the DC level on lead 58 and restores the level of the zero crossing of the 13 KHz component to change the incoming unipolar modulated signal into a sinusoidal signal with a zero crossing. A series diode 102 passes the negative half cycles and a diode 104 eliminates the positive half cycles by shorting them across the source and gate terminals of a JFET 106. A capacitor 108 and a parallel resistor 110 are connected across the source and gate terminals, and together with the diodes 102 and 104 provide a rectifier/filter which, under certain conditions to be discussed, delivers control excitation of negative polarity to the gate of the JFET 106.

The lamp 10 is connected between the supply lead 46 and the drain terminal of a MOSFET 112. The source terminal of MOSFET 112 is grounded, and a zener diode 114 and parallel capacitor 116 are connected across the source and drain terminals for surge protection. The gate of the MOSFET 112 is interconnected with the source terminal of the JFET 106, and a capacitor 118 and parallel resistor 120 extend across this common connection and the source terminal (ground) of the MOSFET 112. Both the JFET 106 and the MOSFET 112 are components of a switching circuit and both are normally in conduction, i.e., with no signals applied to the gate of JFET 106, both the JFET and the MOSFET are in conduction and lamp 10 is energized. Accordingly, the lamp 10 is on when the switching circuit is in its normal condition. It may be appreciated that when JFET 106 is in conduction, positive voltage is applied to the gate of MOSFET 112 and it likewise conducts to complete the energizing circuit to lamp 10.

This switching circuit must be in an excited condition in order to deenergize the lamp 10. Such excited condition occurs only when control excitation is applied to the gate of JFET 106 in response to the 500 Hz safe status signal (lamp maintained off) or the 55 PPM warning rate signal (intermittent flashing).

When the 13/18 KHz oscillator 32 is being toggled at the 500 Hz rate, the 500 Hz safe status signal appears as the modulation envelope and capacitors 108 and 118 develop a continuous negative charge that holds JFET 106 in its nonconductive state. This removes the positive bias from the gate of MOSFET 112 and removes the ground return from lamp 10. Accordingly, the lamp is maintained deenergized whenever the 500 Hz signal is present as the modulation envelope of the control signal from oscillator 32.

When an approaching train is sensed and the oscillator 32 is now toggled at the much slower, 55 PPM rate, the capacitors 108 and 118 are too small to store charge during the off or zero signal half cycles of the envelope; therefore, lamp 10 flashes in synchronism with the half cycles of the incoming control signal bearing the 13 KHz modulation. Accordingly, although the RC network formed by capacitors 108 and 118 and resistors 110 and 120 has a time constant that will cause continuous delivery of negative control excitation to the gate of JFET 106 in response to the 500 Hz safe status signal, the network is ineffective at the much lower flash rate frequency. Representative values are 0.1 microfarad for capacitors 108 and 118, 27,000 ohms for resistor 110, and 24,000 ohms for resistor 120. A suggested JFET is the type 2N5247, and a type BUZ11P MOSFET.

SAFETY FEATURES

Assuming that electrical power is available and that neither of the lamps 10 or 12 burn out and require replacement, the failure mode of the system is evidenced when one lamp of the pair of lamps 10 and 12 is continuously on at full brilliance. Note in FIG. 4 that the presence of a steering diode 124 from the gate of MOSFET 112 to the drain terminal of MOSFET 122 in the co-driver 64 causes only the lamp 12 to remain energized if the control signal to either driver 60 or 64 should fail. Although the steering diode 124 could be omitted, which would result in both lamps 10 and 12 remaining on continuously in the event of failure of the control signal, it is advantageous to limit the failure mode to energization of one lamp to conserve battery power.

Referring to FIG. 1, the significance of the lamp arrangement in the four-lamp warning unit illustrated may now be appreciated. A second crossing control unit identical to that illustrated in FIG. 2 would be connected to the output of 13/18 KHz oscillator 32 to operate the lamp pair 10' and 12'. The lamps 10 and 10' of the respective controllers would be responsive to the 13 Hz modulation, whereas the lamps 12 and 12' in the independent controllers would be responsive to the 18 Hz modulation. Therefore, if both controllers should fail for some reason, lamps 12 and 12' would remain energized and would be visible to vehicular traffic on roadway 16 approaching the crossing from either direction.

An additional safeguard is provided in the present invention by the use of a negative voltage level at the gate of JFET 106 to turn lamp 10 off. No other negative voltages are employed in the circuitry. The only way to develop a continuous negative voltage level and apply it to the gate of the JFET is through the action of the 500 Hz frequency of the safe status signal. Otherwise (no negative level) the JFET is in conduction and the lamp is on. Furthermore, a positive voltage level on the gate of the JFET due to a short circuit or other malfunction likewise places the JFET in conduction. In summary, absent the 500 Hz safe status signal, the two lamps either flash alternately in synchronism with the 55 PPM warning rate signal or lamp 12 operates continuously in the failure mode.

Having thus described the invention, what is claimed as new and desired to be secured by Letters Patent is:

1. A method of controlling a pair of warning lamps at a grade crossing, comprising the steps of:

providing a warning rate signal having a predetermined repetition rate, providing a safe status signal having a predetermined frequency different from the repetition rate of said warning rate signal, providing an oscillator having two output frequencies substantially higher than the frequencies of said warning rate and safe status signals, alternating the output of said oscillator between said frequencies thereof in synchronism with said warning rate signal when a train is approaching or present at a crossing, or in synchronism with said safe status signal in the absence of a train, flashing a first lamp of said pair of lamps exclusively in response to one of said output frequencies of the oscillator when the output of the oscillator is alternated by the warning rate signal, flashing the other lamp of said pair of lamps exclusively in response to the other output frequency of said oscillator when the output of the oscillator is alternated by the warning rate signal, and maintaining said pair of lamps deenergized whenever said oscillator output is alternated by the safe status signal.

2. Crossing control apparatus for activating a warning when a train is approaching or present at a crossing, said apparatus comprising:

a warning unit having at least one electrically operated warning device, means for generating a warning rate signal having a predetermined repetition rate, means for generating a safe status signal having a predetermined frequency different from the repetition rate of said warning rate signal, a driver connected with said unit for controlling the energization and deenergization of said device in response to said signals, and including circuit means having a normal condition in which said device is energized and an excited condition in which said device is deenergized, means responsive to an approaching or present train for delivering said warning rate signal to said driver, and for delivering said safe status signal thereto in the absence of a train, and said driver having frequency sensitive means responsive to said warning rate signal for causing said circuit means to alternate between said conditions thereof to operate said device at the warning rate, and responsive to said safe status signal for maintaining said circuit means in its excited condition to thereby maintain said device inoperative.

3. The apparatus as claimed in claim 2, wherein said circuit means includes an electrically responsive switching component normally in conduction, and wherein said frequency sensitive means delivers continuous control excitation to said component to render the same nonconductive in response to said safe status signal, and delivers said control excitation to said component intermittently at said warning rate in response to said warning rate signal.

4. The apparatus as claimed in claim 2, wherein the frequency of said safe status signal is substantially higher than the repetition rate of said warning rate signal.

5. The apparatus as claimed in claim 4, wherein said circuit means includes an electrically responsive switching component normally in conduction, and wherein said frequency sensitive means includes an RC network having a time constant causing continuous delivery of control excitation to said component to render the same nonconductive in response to said safe status signal, and intermittent delivery of said excitation at said warning rate in response to said warning rate signal.

6. Crossing control apparatus for activating a warning when a train is approaching or present at a crossing, said apparatus comprising:

a warning unit having first and second electrically operated warning devices, means for generating a warning rate signal having a predetermined repetition rate, means for generating a safe status signal having a predetermined frequency different from the repetition rate of said warning rate signal, first and second drivers connected with corresponding devices for controlling the energization and deenergization of said devices in response to said signals, and each including circuit means having a normal condition in which the corresponding device is energized and an excited condition in which the device is deenergized, crossing status means responsive to an approaching or present train and including oscillator means having first and second output frequency components substantially higher than the frequencies of said warning rate and safe status signals, gate means connected with said oscillator means and responsive to said warning rate and safe status signals for alternating the output of said oscillator means between said first and second frequencies in synchronism with the signal that is indicative of the status of the crossing, whereby the output of said oscillator means provides a two-component control signal that alternates between said components at the warning rate when a train is approaching or present and alternates at the safe status signal frequency in the absence of a train, frequency responsive filter means interposed between the output of said oscillator means and said drivers for delivering the component of said control signal at said first frequency exclusively to said first driver and delivering the component of said control signal at said second frequency exclusively to said second driver, and each of said drivers having frequency sensitive means responsive to said warning rate for causing its circuit means to alternate between said conditions thereof to operate the corresponding device at the warning rate, and responsive to said safe status frequency for maintaining the circuit means in its excited condition to thereby maintain the corresponding device inoperative, whereby said first and second devices are alternately energized at the warning rate when a train is approaching or present at the crossing.

7. The apparatus as claimed in claim 6, further comprising a current-carrying conductor terminating at said devices for supplying the same with energizing power, modulation means coupled between said oscillator means and said conductor for modulating the energizing current with said two-component control signal, and means connecting said filter means to said conductor adjacent said devices.

8. The apparatus as claimed in claim 6, wherein said circuit means of each driver includes an electrically responsive switching component normally in conduction, and wherein said frequency sensitive means of each driver delivers continuous control excitation to said component to render the same nonconductive in response to said safe status frequency, and delivers said control excitation to said component intermittently at said warning rate in response to said warning rate signal.

9. The apparatus as claimed in claim 6, wherein the frequency of said safe status signal is substantially higher than the repetition rate of said warning rate signal.

10. The apparatus as claimed in claim 9, wherein said circuit means of each driver includes an electrically responsive switching component normally in conduction, and wherein said frequency sensitive means thereof includes an RC network having a time constant causing continuous delivery of control excitation to said component to render the same nonconductive in response to said safe status frequency, and intermittent delivery of said excitation at said warning rate in response to said warning rate signal.

* * * * *